United States Patent [19]

Blank et al.

[11] 3,976,517

[45] Aug. 24, 1976

[54] PROCESSING FOR GRAIN-ORIENTED SILICON STEEL

[75] Inventors: Denis A. Blank, Springdale; Edward C. Falkowski, Pittsburgh; Richard K. Pitler, Gibsonia, all of Pa.

[73] Assignee: Allegheny Ludlum Industries, Inc., Pittsburgh, Pa.

[22] Filed: July 15, 1975

[21] Appl. No.: 596,558

[52] U.S. Cl. ..... 148/111; 148/112; 148/120

[51] Int. Cl.[2] ..... H01F 1/04

[58] Field of Search ..... 148/111, 112, 31.55, 148/120; 75/123 L; 72/364, 365

[56] References Cited

UNITED STATES PATENTS 3,846,187 11/1974 Sakakura et al. ..... 148/111

3,872,704 3/1975 Ohya et al. ..... 148/111

*Primary Examiner*—Walter R. Satterfield

*Attorney, Agent, or Firm*—Vincent G. Gioia; Robert F. Dropkin

[57] ABSTRACT

A process for producing electromagnetic silicon steel having a cube-on-edge orientation. The process includes the steps of: preparing an aluminum-bearing melt of silicon steel; casting the steel into an ingot; soaking the ingot at an elevated temperature; hot rolling the ingot into a bar of less than 2 inches in thickness; hot rolling the bar into a band of less than 0.2 inch in thickness, when the bar is at a temperature of from 1800 to 1900°F; heat treating the steel; cold rolling the steel at a reduction of at least 75%; decarburizing the steel; and final texture annealing the steel.

2 Claims, No Drawings

PROCESSING FOR GRAIN-ORIENTED SILICON STEEL

The present invention relates to an improvement in the manufacture of grain-oriented silicon steel.

Researchers have devoted a considerable amount of time to improving the magnetic quality of aluminum-bearing oriented silicon steels, and to the ability to produce consistently high magnetic quality from one coil to another, as well as from one end of a coil to the other. These efforts have involved in depth studies of each step in the manufacture of such steels. Through this invention a process for attaining such results is now known.

The present invention zeros in on the hot rolling of aluminum-bearing silicon steels. More specifically, it calls for finish rolling at a starting temperature substantially lower than that used heretofore. The starting temperature is from 1800° to 1900°F.

U.S. Pat. No. 3,846,187 describes processing for aluminum-bearing silicon steels, and speaks in depth about finish rolling temperatures. It does not, however, disclose finish rolling at starting temperatures as low as 1900°F, for steel containing at least 2.8% silicon. Moreover, its teachings are contradictory to the subject invention. It discloses the need to raise the temperature of the steel prior to finish rolling and/or the need to shorten the time period at which the material is at an elevated temperature subsequent to heating and prior to finish rolling. The present invention, on the other hand, requires a temperature of 1900°F or less, and allows for whatever time it takes for the material to cool to a temperature at least as low as 1900°F.

It is accordingly an object of the present invention to provide an improvement in the manufacture of aluminum-bearing, grain-oriented silicon steel.

In accordance with the present invention, a melt of silicon steel is subjected to the conventional steps of casting an ingot therefrom, soaking the ingot at an elevated temperature, hot rolling the ingot into a bar of less than 2 inches in thickness, hot rolling the bar into a band of less than 0.2 inch in thickness, heat treating, cold rolling at a reduction of at least 75%, decarburizing and final texture annealing; and to the improvement comprising the step of commencing the hot rolling of the bar into the band when the bar is at a temperature of from 1800° to 1900°F. The melt contains, by weight, up to 0.7% carbon, from 2.8 to 4.0% silicon, from 0.03 to 0.24% manganese, from 0.01 to 0.09% of material from the group consisting of sulfur and selenium, from 0.015 to 0.04% aluminum, up to 0.02% nitrogen, up to 0.5% copper and up to 0.0035% boron. As a general rule the balance of the melt is essentially iron. The invention does not, however, preclude the presence of other elements which improve magnetic properties. Specific processing, as to the conventional steps, is not critical and can be in accordance with that specified in any number of publications including U.S. Pat. Nos. 3,855,018, 3,855,019, 3,855,020 and 3,855,021. The ingot is soaked at a temperature in excess of 2300°F and preferably at a temperature in excess of 2450°F. A preferred temperature range for commencing the hot rolling of the bar into a band is from 1825° to 1875°F. As a general rule, a period in excess of 100 seconds passes from completion of the last heating of the steel to the commencement of hot rolling from the 1800° to 1900°F temperature range.

The following examples are illustrative of several aspects of the invention.

EXAMPLE I

Three samples (Samples A, B & C) of silicon steel were respectively cast and processed into silicon steel having a cube-on-edge orientation, from three heats (Heats A, B & C) of silicon steel. The chemistry of the heats appears hereinbelow in Table I.

TABLE I

| | Compositon (Wt. %) | | | | | | | | |
|---|---|---|---|---|---|---|---|---|---|
| Heat | C | Si | Mn | S | Al | N | Cu | B | Fe |
| A. | 0.046 | 2.88 | 0.12 | 0.049 | 0.024 | 0.0056 | 0.20 | 0.0003 | Bal. |
| B. | 0.052 | 2.95 | 0.089 | 0.046 | 0.033 | 0.0058 | 0.19 | 0.0004 | Bal. |
| C. | 0.063 | 2.90 | 0.097 | 0.043 | 0.028 | 0.0061 | 0.17 | 0.0004 | Bal. |

Processing for the samples involved soaking at a temperature in excess of 2450°F, hot rolling to a bar approximately 1.2 inches thick, hot rolling to a band approximately 93 mils thick, heat treating at 2050°F, cold rolling to a gage of approximately 11.5 mils, decarburizing for 2 minutes at 1475°F, and final texture annealing at a temperature of about 2150°F. Hot rolling of the bars into bands commenced when the bars were at the following temperatures.

A. 2210°F
B. 2030°F
C. 1850°F

The samples were subsequently tested for permeability and core loss. The results of the tests appear hereinbelow in Table II.

TABLE II

| Sample | Core Loss (WPP at 17KB) | Permeability (at 10 $O_r$) |
|---|---|---|
| A. | 0.809 | 1893 |
| B. | 0.692 | 1936 |
| C. | 0.676 | 1940 |

From Table II, it is clear that the processing of the present invention is highly beneficial to the properties of aluminum-bearing silicon steel. An improvement is seen in both core loss and permeability when finish rolling commences at a temperature between 1800° and 1900°F. Note that the core loss of Sample C is 0.676 watts per pound whereas the values for Samples A and B are respectively 0.809 and 0.692.

EXAMPLE II

Three groupings of three samples (Samples $A_1$ through $C_1$, $A_2$ through $C_2$ and $A_3$ through $C_3$) of silicon steel were cast and processed into silicon steel having a cube-on-edge orientation. Samples $A_1$ through $A_3$, $B_1$ through $B_3$ and $C_1$ through $C_3$ were respectively processed as were Samples A, B and C, with the following exception:

1. The hot rolled bands of Samples $A_1$ through $C_1$ were decarburized for 15 minutes at 1475°F in dry hydrogen;
2. The hot rolled bands of Samples $A_2$ through $C_2$ were decarburized for 30 minutes at 1475°F in dry hydrogen; and
3. The hot rolled bands of Samples $A_3$ through $C_3$ were decarburized for 60 minutes at 1475°F in dry hydrogen.

The respective melt chemistries for Samples $A_1$ through $A_3$, $B_1$ through $B_3$ and $C_1$ through $C_3$ are the same as for Samples A, B and C.

The samples were subsequently tested for permeability and core loss. The results of the tests appear hereinbelow in Table III.

TABLE III

| Sample | Core Loss (WPP at 17KB) | Permeability (at 10 $O_e$) |
|---|---|---|
| $A_1$ | 0.773 | 1903 |
| $B_1$ | 0.711 | 1934 |
| $C_1$ | 0.697 | 1929 |
| $A_2$ | 0.814 | 1885 |
| $B_2$ | 1.45 | 1520 |
| $C_2$ | 0.712 | 1922 |
| $A_3$ | 0.911 | 1818 |
| $B_3$ | — | 1471 |
| $C_3$ | 0.695 | 1943 |

Table III demonstrates how the subject invention adds stability to the manufacture of aluminum-bearing oriented silicon steel. More specifically, it sets forth data which shows that the subject invention renders the manufacture of such steel relatively insensitive to a degree of variation in the carbon content of the hot rolled band. For example, note the variation in properties for the A and B samples for which finish rolling respectively commenced at 2210°F and 2030°F; and the small degree of variation in properties for the C samples for which finish rolling commenced at a temperature between 1800° and 1900°F. The commencement of finish rolling at a temperature between 1800° and 1900°F goes to the heart of the subject invention.

EXAMPLE III

Additional samples (Samples $D_1$, $D_2$ and $D_3$) of silicon steel were respectively cast and processed into silicon steel having a cube-on-edge orientation, from a heat (Heat D) of silicon steel. The chemistry of the heat appears hereinbelow in Table IV.

TABLE IV

| Heat | C | Si | Mn | S | Al | N | Cu | B | Fe |
|---|---|---|---|---|---|---|---|---|---|
| | Composition (wt. %) | | | | | | | | |
| D | 0.054 | 2.90 | 0.11 | 0.048 | 0.033 | 0.0063 | 0.19 | 0.0003 | Bal. |

Processing for the samples involved soaking at a temperature in excess of 2450°F, hot rolling to a bar approximately 1.2 inches thick, hot rolling to a band approximately 93 mils thick, heat treating at 2050°F, cold rolling to a gage of approximately 11.5 mils, decarburizing for 2 minutes at 1475°F, and final texture annealing at a temperature of about 2150°F. Hot rolling of the bars into bands commenced when the bars were at 1850°F. Hot rolled bands $D_1$, $D_2$ and $D_3$ were respectively decarburized at 1475°F in dry hydrogen for 15, 30 and 60 minutes.

The samples were subsequently tested for permeability and core loss. The results of the tests appear hereinbelow in Table V.

TABLE V

| Sample | Core Loss (WPP at 17 KB) | Permeability (at 10 $O_e$) |
|---|---|---|
| $D_1$ | 0.665 | 1919 |
| $D_2$ | 0.688 | 1916 |
| $D_3$ | 0.743 | 1869 |

Table IV, like Table III, demonstrates how the subject invention adds stability to the manufacture of aluminum-bearing oriented silicon steel. Note the variation in properties for the B samples (Table III) for which finish rolling commenced at 2030°F; and the substantially smaller degree of variation in properties for the D samples for which finish rolling commenced at a temperature between 1800° and 1900°F. Significantly, the chemistry and processing for the B and D samples are remarkably similar, with the exception of the temperatures at which finish rolling commenced.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. In a process for producing electromagnetic silicon steel having a cube-on-edge orientation and a permeability of at least 1850 ($G/O_e$) at 10 oersteds, which process includes the steps of: preparing a melt of silicon steel containing, by weight, up to 0.07% carbon, from 2.8 to 4.0% silicon, from 0.03 to 0.24% manganese, from 0.01 to 0.09% of material from the group consisting of sulfur and selenium, from 0.015 to 0.04% aluminum, up to 0.02% nitrogen, up to 0.5% copper and up to 0.0035% boron; casting said steel into an ingot; soaking said ingot at an elevated temperature; hot rolling said ingot into a bar, said bar being less than 2 inches thick; hot rolling said bar into band, said band being less than 0.2 inch thick; heat treating said steel; cold rolling said steel at a reduction of at least 75%; decarburizing said steel; and final texture annealing said steel; the improvement comprising the step of commencing said hot rolling of said bar into said band when said bar is at a temperature of from 1800° to 1900°F.

2. An improvement according to claim 1, wherein said hot rolling of said bar into said band is commenced when said bar is at a temperature of from 1825° to 1875°F.

* * * * *